US006398063B1

(12) United States Patent
Sternick

(10) Patent No.: US 6,398,063 B1
(45) Date of Patent: Jun. 4, 2002

(54) SANITARY BEVERAGE SERVING APPARATUS

(76) Inventor: Scott M. Sternick, 1 Ave. at Port Imperial Apt. No. 1135, West New York, NJ (US) 07093

( * ) Notice: Subject to any disclaimer, the term of this patent is extended or adjusted under 35 U.S.C. 154(b) by 0 days.

(21) Appl. No.: 09/477,566

(22) Filed: Jan. 6, 2000

(51) Int. Cl.[7] ..... B65D 25/20

(52) U.S. Cl. ..... 220/700; 211/70.7; 211/85.4; 248/37.6

(58) Field of Search ..... 211/70.7, 85.4, 211/85.5, 85.12; 248/37.6; 215/390; 220/703, 700; 100/133

(56) References Cited

U.S. PATENT DOCUMENTS

| | | | | | |
|---|---|---|---|---|---|
| 344,567 | A | * | 6/1886 | Coleman | 215/391 |
| 670,502 | A | * | 3/1901 | Anderson | 164/247 |
| 1,211,171 | A | * | 1/1917 | Kershner | 248/37.6 |
| 1,321,048 | A | * | 11/1919 | Johnson | 248/37.6 |
| 1,517,164 | A | * | 11/1924 | Lear | 15/264 |
| 1,809,410 | A | * | 6/1931 | Gross | 100/133 |
| 1,848,450 | A | * | 3/1932 | Williamson | 220/700 |
| 2,255,750 | A | * | 9/1941 | Whorton | 100/133 |
| 2,590,286 | A | * | 3/1952 | Wirtanen et al. | 248/37.6 |
| 2,597,275 | A | * | 5/1952 | Ahlstrand | 248/37.6 |
| 2,919,086 | A | * | 12/1959 | McMahan | 248/37.6 |
| 3,169,005 | A | * | 2/1965 | Wallach | 248/74.3 |
| 4,632,347 | A | * | 12/1986 | Jurgich | 248/213.2 |
| D296,861 | S | * | 7/1988 | Fielding et al. | D7/402 |
| 4,846,076 | A | * | 7/1989 | Menges, Sr. et al. | 108/42 |
| 5,730,405 | A | * | 3/1998 | Nichols, IV | 248/213.2 |

* cited by examiner

*Primary Examiner*—Lee Young
*Assistant Examiner*—Joseph C. Merek
(74) *Attorney, Agent, or Firm*—John R. Mugno

(57) ABSTRACT

A beverage serving apparatus for easily and sanitarily providing accompaniments to a beverage in a container is described. The beverage serving apparatus comprises: (i) a handling portion designed to avoid contact with the beverage; (ii) a container attachment portion for coupling the apparatus to the rim of the container; (iii) a first accompaniment attachment portion shaped to receive a first accompaniment; and (iv) a second accompaniment attachment portion shaped to receive a second accompaniment. Both the first accompaniment attachment portion and the second accompaniment attachment portion can comprise various designs including an elongated slot, a circular slot, a pressure clip, a pointed end, etc. In addition, the container attachment portion of the described beverage serving apparatus can comprise a flexible slot, a pressure clip, or various other designs. The beverage serving apparatus of the present invention can further include advertising materials to provide a novel means of promoting a product or service.

11 Claims, 1 Drawing Sheet

SANITARY BEVERAGE SERVING APPARATUS

FIELD OF THE INVENTION

This invention is generally directed to the serving of beverages in a glass or cup, particularly in public eating and/or drinking establishments. More specifically, the beverage serving apparatus of the present invention provides a convenient and sanitary means for attaching accompaniments to various beverages that are contained in a glass or cup. Furthermore, the sanitary beverage serving apparatus of the present invention can provide an effective, yet inexpensive, advertising vehicle.

BACKGROUND OF THE INVENTION

Many common beverages served today in restaurants, drinking establishments, etc. are typically served with accompaniments that permit the customer to suit the beverage to his/her desired taste. For instance, unsweetened lemonade is typically served with a long spoon for stirring in added sugar to meet desired taste. iced tea is often served with a special elongated spoon, lemon, and sugar for taste. Many alcoholic beverages are served with stirrers, olives, cherries, etc. for both taste and decorative purpose. Countless beverages requiring common accompaniments exist in both restaurant and home use.

Regrettably, most establishments serve such beverages with the desired accompaniments either immersed in, or floating on, the beverage to be consumed by the customer. For instance, when most restaurants serve iced tea, a slice of lemon is either set floating within the beverage or secured to the rim of the serving glass by means of a partial cut, and the serving spoon is placed in the beverage. In such conventional situations, if the customer determines that the spoon was unsanitary, the beverage should be totally replaced. Furthermore, the end of the spoon extending outwardly from the rim of the glass often causes either the server or customer to spill the beverage, thus requiring both a replacement beverage and a time-consuming clean-up.

There is another technique used by servers at eating and drinking establishments when serving edible accompaniments to a beverage. The edible accompaniment will be speared with a decorative toothpick and either balanced on the rim of a glass or immersed within the beverage. When immersed in the beverage, the result once again is unsanitary if the toothpick was unclean. When balanced on the rim of a glass, the edible accompaniments often fall in the beverage or, worse, fall on the server's tray. In such instances, the server typically places the edible accompaniments back on the rim of the glass resulting in all the germs that were on the tray being placed in the beverage and/or on the glass. Since servers often place tips, etc. on their serving trays, the result is extremely unsanitary.

While the owners of eating and drinking establishments would desire a more convenient and sanitary means for serving beverages requiring one or more accompaniments, any replacement serving means should be both inexpensive and require the purchase of no additional glassware, cups, etc. Regrettably, no such serving apparatus is available today.

It is therefore a primary object of the present invention to provide a new and improved beverage serving apparatus which includes accompaniments.

It is another object of the present invention to provide a new and improved beverage serving apparatus which includes accompaniments that is more sanitary than serving devices presently available in the prior art.

It is yet a further object of the present invention to provide a new and improved beverage serving apparatus which includes accompaniments that is more convenient and results in less spillage than serving devices presently available in the prior art.

It is yet still a further object of the present invention to provide a new and improved beverage serving apparatus which includes accompaniments that does not result in significantly increased costs.

It is still another object of the present invention to provide a new and improved beverage serving apparatus which includes accompaniments upon which valuable advertising can be placed.

It is yet an additional object of the present invention to provide a new and improved beverage serving apparatus which includes accompaniments that provides each of the aforementioned advantages without requiring the purchase of any additional glassware, cups, etc.

Other objects and advantages of the present invention will become apparent from the specification and the drawings.

SUMMARY OF THE INVENTION

Briefly stated and in accordance with the preferred embodiment of the present invention, a beverage serving apparatus for easily and sanitarily providing accompaniments to a beverage in a container is described. The beverage serving apparatus comprises: (i) a handling portion designed to avoid contact with the beverage; (ii) a container attachment portion for coupling the apparatus to the rim of the container; (iii) a first accompaniment attachment portion shaped to receive a first accompaniment; and (iv) a second accompaniment attachment portion shaped to receive a second accompaniment. Both the first accompaniment attachment portion and the second accompaniment attachment portion can comprise various designs including an elongated slot, a circular slot, a pressure clip, a pointed end (similar to a toothpick), etc. In addition, the container attachment portion of the described beverage serving apparatus can comprise a flexible slot, a pressure clip, or various other designs. The beverage serving apparatus of the present invention can further include advertising materials to provide a novel means of promoting a product or service.

BRIEF DESCRIPTION OF THE DRAWINGS

While the specification concludes with claims particularly pointing out and distinctly claiming the subject matter regarded as the invention herein, it is believed that the present invention will be more readily understood upon consideration of the description, taken in conjunction with the accompanying drawings, wherein:

DESCRIPTION OF THE PREFERRED EMBODIMENT

Figure 1:
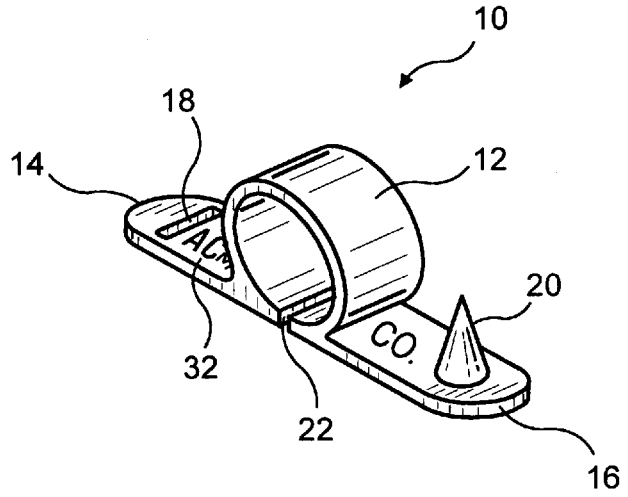
FIG. 1 is a schematic illustration of the preferred embodiment of a beverage serving apparatus in accordance with the present invention.

Referring first to FIG. 1, a beverage serving apparatus generally designated 10 is shown which represents a preferred embodiment of the present invention. Beverage serving apparatus 10 preferably includes a handling portion 12 from which extends a first end 14 of beverage serving apparatus 10 and an opposite extending second end 16 of beverage serving apparatus 10. On first end 14 is a first accompaniment attachment portion 18. On second end 16 is a second accompaniment attachment portion 20. Beverage serving apparatus 10 also includes a glass (or container) attachment portion 18.

Figure 2:
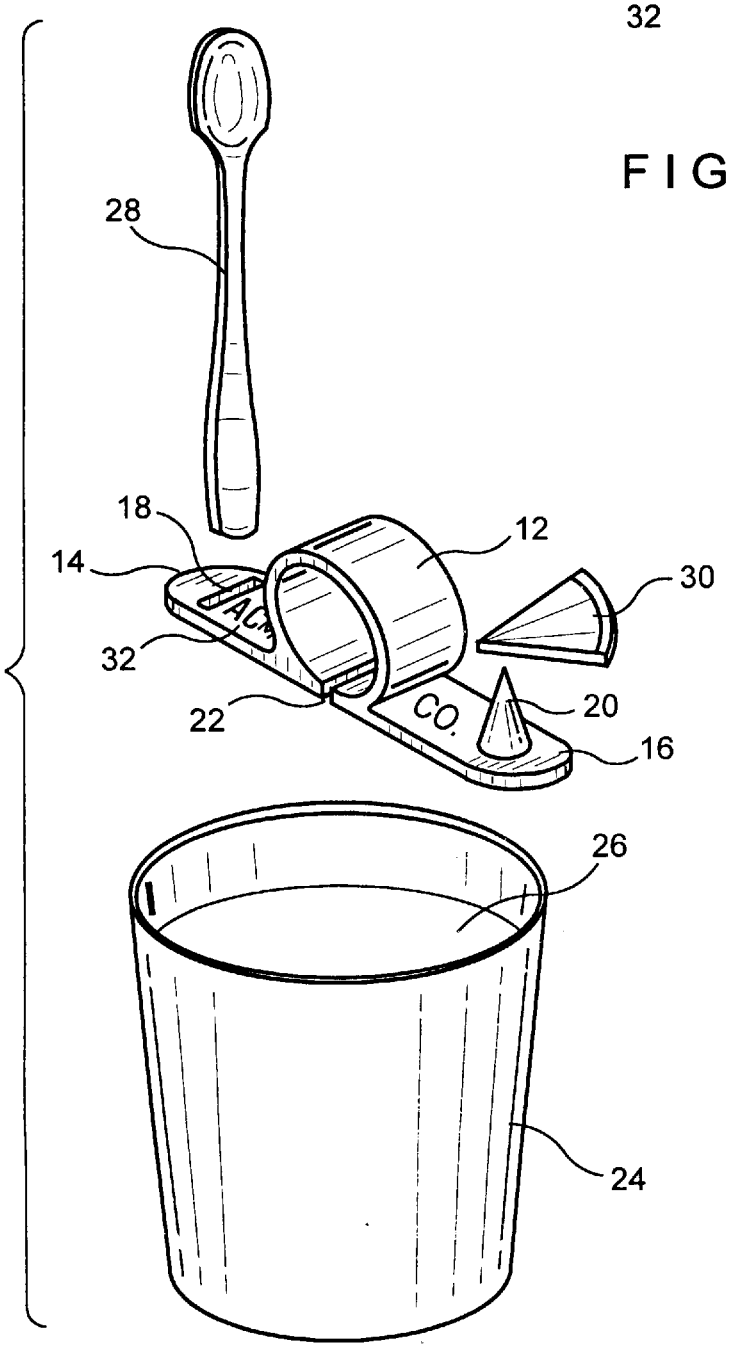
FIG. 2 is a schematic and exploded illustration of the preferred embodiment of the beverage serving apparatus shown in FIG. 1 as utilized in conjunction with a beverage served in a glass.

In FIG. 1, handling portion 12 is depicted as a generally circular device that would generally be enclosed except for the flexible slot that forms glass attachment portion 18. Handling portion 12 is the part of beverage serving apparatus 10 which the server should contact to place beverage serving apparatus 10 on a glass 24 as shown in FIG. 2. By properly handling beverage serving apparatus 10, the server can avoid any contamination of a beverage 26 in glass 24. The generally circular form of handling portion 12 can easily be replaced by alternate designs, including a three dimensional depiction of a corporate logo, corporate advertising character, etc. In such instances, beverage serving apparatus 10 becomes, in effect, a marketing vehicle.

First accompaniment attachment portion 18 has been depicted in FIG. 1 and FIG. 2 as a hollowed elongated slot sized to receive the handle of a spoon 28. Spoon 28 should be of sufficient length so that its handle is not longer than the height of glass 24 (thereby allowing easy placement of glass 24 on a flat surface) but long enough to stir beverage 26 without the customer needing to immerse her/his fingers into beverage 26.

Second accompaniment attachment portion 20 is depicted in FIG. 1 and FIG. 2 as a generally conically shaped device that can easily engage a lemon wedge 30 as shown in exploded form in FIG. 2. The tip of second accompaniment attachment portion 20 as depicted in the FIGURES should be sufficiently pointed so that the lemon can easily be attached upon slight pressure by the server, but not so sharp as to cause unnecessary injury.

The preferred embodiment of glass attachment portion 22, as depicted in FIG. 1 and FIG. 2, is a cut out slot of sufficient width that can be snuggly fit onto the rim of glass 24. Since beverage serving apparatus 10 would preferably be comprised of a flexible plastic or rubber material, the slot of glass attachment portion 22 can be expanded to be placed on the rim of glass 24 yet still fit securely. Due to the flexibility of beverage serving apparatus 10, if the server or customer inadvertently puts pressure on the portion of spoon 28 extending upwardly from glass 24, beverage serving apparatus 10 would usually become disengaged from glass 24 as opposed to tipping glass 24 and thereby spilling beverage 26.

Obviously, the preferred embodiment of the present invention as depicted by beverage serving apparatus 10 is particularly well suited for serving iced tea. However numerous variations for both first accompaniment attachment portion 18 and second accompaniment attachment portion 20 exist. For instance, instead of an elongated slot or generally conically shaped attachment means, a pressure clip or pointed end could be used. Other variations, such as a spongy circular slot to easily hold a straw should also be known to those skilled in the art.

Numerous variations to glass attachment portion 22 should also be known to those skilled in the art. For instance, particularly when beverages are served in very low cups, a pressure clip would prove more convenient than a hollowed slot. Additionally, a beverage serving apparatus in accordance with the present invention can be made that is permanently affixed to a glass. Of course, in such instances, beverage serving apparatus 10 should be dishwasher safe and highly durable.

Although not required, preferably beverage serving apparatus 10 will be comprised of a single composite (e.g., die cast or molded) plastic material. Thus, beverage serving apparatus 10 is very inexpensive to produce. However, any costs associated with manufacturing beverage serving apparatus 10 can be overcome (or perhaps the device can become profitable in and of itself) based on receipt of advertising fees. It has already been described that handling portion 12 can take the form of a corporate logo, corporate character, etc. Furthermore, any advertising literature, such as depicted by advertising writing 32 in FIG. 1 and FIG. 2, can easily be placed on beverage serving apparatus 10. Thus, beverage serving apparatus 10 also provides a valuable marketing tool.

It will be apparent from the foregoing description that the present invention provides a new and improved beverage serving apparatus which is inexpensive, sanitary, and easy to use. Furthermore, the beverage serving apparatus of the present invention provides a novel and effective advertising tool. While a specific and effective preferred embodiment has been described, numerous alternatives exist. For instance, the various accompaniment attachment portion forms can be made detachable so that the server could select the desired form and/or choose to use only one accompaniment attachment portion, as opposed to two or more.

While there has been shown and described what is presently considered to be the preferred embodiment of this invention, it will be obvious to those skilled in the art that various changes and modifications may be made without departing from the broader aspects of this invention. For instance, although the materials described herein to manufacture the beverage serving apparatus of the present invention are flexible, rigid materials might also be incorporated. Moreover, the beverage serving apparatus of the present invention can provide a novel way to consume edible accompaniments that are served with a beverage. For instance, the consumption of straight tequila is usually preceded by licking salt and proceeded by biting into a tart lemon. Such accompaniments can be served directly on (and consumed directly off) the beverage serving apparatus of the present invention. Additionally, the apparatus of the present invention can also be utilized to provide accompaniments to a food (besides beverages) by attaching it to the rim of a bowl.

It is, therefore, aimed in the appended claims to cover all such changes and modifications as fall within the true scope and spirit of the invention.

I claim:

1. A food service apparatus for serving at least one accompaniment with a food or beverage in a container comprising a rim, the apparatus comprising:

a handing portion designed to avoid contact with said food;

a container attachment portion for coupling said apparatus to said rim of said container, said container attachment portion comprising a cut-out slot generally in the center of the apparatus, and of sufficient width to selectively and securely attach said apparatus to said rim and also be removable therefrom;

said apparatus having an first end on a first side of said slot and a second end on a second side of the slot, a first accompaniment attachment portion shaped to receive a first accompaniment, said first accompaniment portion being disposed adjacent and spaced from said first end; a second accompaniment attachment portion comprising a tapered end having a sharp tip to receive a second accompaniment, said second accompaniment attachment portion being adjacent and spaced from said second end;

said apparatus having a generally planar bottom surface.

2. The apparatus of claim 1 wherein said container is a cup.

3. The apparatus of claim 1 wherein said container is a glass.

4. The apparatus of claim 1 wherein said container is a bowl.

5. The apparatus of claim 1 wherein said apparatus is comprised of a single composite material.

6. The apparatus of claim 1 wherein said material is plastic.

7. The apparatus of claim 1 which further comprises advertising material on said apparatus.

8. A food service apparatus for serving a lemon and a spoon with a beverage in a glass, said apparatus comprising:

a handling portion designed to avoid contact with said beverage;

a glass attachment portion for coupling said apparatus to the rim of said glass, said glass attachment portion comprising a cut-out slot generally in the center of said apparatus, and of sufficient width to selectively and securely attach said apparatus to said rim and also be removable therefrom;

a first accompaniment attachment portion comprising a hollowed slot designed to receive the handle of said spoon but prevent said spoon from slipping completely through said hollowed slot; and a second accompaniment attachment portion, opposite said first accompaniment attachment portion, comprising a general conically shaped apparatus having a sharp tip to receive said lemon.

9. The apparatus of claim 8 wherein said apparatus is comprised of a single composite material.

10. The apparatus of claim 9 wherein said composite material is plastic.

11. The apparatus of claim 8 which further comprises advertising material on said apparatus.

* * * * *